US011439859B2

(12) United States Patent
Shangguan

(10) Patent No.: US 11,439,859 B2
(45) Date of Patent: Sep. 13, 2022

(54) MULTIFUNCTIONAL FITNESS HORIZONTAL BAR

(71) Applicant: NINGBO ESTLEYS ELECTRONIC COMMERCE CO., LTD, Ningbo (CN)

(72) Inventor: Xin Shangguan, Ningbo (CN)

(73) Assignee: NINGBO ESTLEYS ELECTRONIC COMMERCE CO., LTD, Ningbo (CN)

( * ) Notice: Subject to any disclaimer, the term of this patent is extended or adjusted under 35 U.S.C. 154(b) by 20 days.

(21) Appl. No.: 17/111,788

(22) Filed: Dec. 4, 2020

(65) Prior Publication Data

US 2022/0152440 A1 May 19, 2022

(30) Foreign Application Priority Data

Nov. 18, 2020 (CN) ..... 202022682390.9

(51) Int. Cl.

| | |
|---|---|
| ***A63B 1/00*** | (2006.01) |
| ***A63B 21/068*** | (2006.01) |
| ***A63B 21/16*** | (2006.01) |
| ***A63B 23/12*** | (2006.01) |

(52) U.S. Cl.

CPC ..... *A63B 1/00* (2013.01); *A63B 21/068* (2013.01); *A63B 21/1627* (2013.01); *A63B 23/1218* (2013.01)

(58) Field of Classification Search

CPC ..... A63B 1/00; A63B 21/068; A63B 21/1618; A63B 21/1627; A63B 21/1636; A63B 23/1218

See application file for complete search history.

(56) References Cited

U.S. PATENT DOCUMENTS

| | | | | |
|---|---|---|---|---|
| 2,423,799 | A * | 7/1947 | Shelstad | B60D 1/025 280/515 |
| 2012/0129658 | A1* | 5/2012 | Hunt | A63B 23/1218 482/38 |
| 2014/0323275 | A1* | 10/2014 | Moses, II | A63B 21/4043 482/40 |
| 2015/0031508 | A1* | 1/2015 | Goldberg | A63B 21/4035 482/106 |
| 2018/0028856 | A1* | 2/2018 | Sanseverino | A63B 21/16 |

* cited by examiner

*Primary Examiner* — Erin Deery
*Assistant Examiner* — Peter H Forstner
(74) *Attorney, Agent, or Firm* — Li & Cai Intellectual Property (USA) Office

(57) ABSTRACT

A multifunctional fitness horizontal bar which relates to the technical field of fitness horizontal bars, comprises: an outer tube, an inner tube telescopically and axially assembled on both ends of the outer tube, a support part provided on the outer side of the inner tube, and a plurality of hanging buckles provided on the outer tube and/or the inner tube, wherein a mounting hole is provided on each of the plurality of hanging buckles. Adopting the above technical solution has the advantage of being convenient to be used in combination with other fitness equipment.

5 Claims, 3 Drawing Sheets

MULTIFUNCTIONAL FITNESS HORIZONTAL BAR

FIELD OF THE DISCLOSURE

The present disclosure relates to the technical field of fitness horizontal bars, in particular to a multifunctional fitness horizontal bar.

BACKGROUND OF THE DISCLOSURE

Fitness exercises can use a variety of freehand exercises, such as a variety of freehand aerobics, rhythmic gymnastics, shape gymnastics and various self-resistance movements. It can also use a variety of different sports equipment for various exercises, such as dumbbells, barbells, kettlebells and other weight lifting equipment, horizontal bars, parallel bars, ropes, rods and other gymnastic equipment, as well as spring tensioners, pulley tensioners, elastic bands and various special strength training equipment such as comprehensive strength exercise racks, as well as aerobic training equipment such as power bicycles, steppers, flat treadmills, and rowing machines.

Due to limited space and equipment, fitness horizontal bars (or horizontal bars above the door) are becoming more and more popular, but the existing fitness horizontal bars cannot be combined with other fitness equipment. The exercise method is single and cannot meet people's multiple needs, so there is room for improvement.

SUMMARY OF THE DISCLOSURE

The primary purpose of the present disclosure is to provide a multifunctional fitness horizontal bar aiming at the defects and deficiencies of the prior art, which has the advantage of being convenient to be used in combination with other fitness equipment.

In order to achieve the above purpose, the technical solution adopted by the present disclosure is to provide a multifunctional fitness horizontal bar, comprising: an outer tube, an inner tube telescopically and axially assembled on both ends of the outer tube, a support part provided on the outer side of the inner tube, and a plurality of hanging buckles provided on the outer tube and/or the inner tube, wherein a mounting hole is provided on each of the plurality of hanging buckles.

In a preferred embodiment, each of the plurality of hanging buckles comprises: a fixed hanging buckle fixedly assembled on the middle of the outer tube, and a rotating hanging buckle assembled on the outer end of the inner tube and being capable of rotating 360° around the inner tube.

In a preferred embodiment, the multifunctional fitness horizontal bar further comprises: an adjustable support member telescopically and axially assembled on the outer end of the inner tube.

In a preferred embodiment, a safety nut for locking is arranged between the adjustable support member and the inner tube.

In a preferred embodiment, a first adjustment hole is provided on both ends of the outer tube, a plurality of second adjustment holes are provided on the inner tube, and the multifunctional fitness horizontal bar further comprises: a locking device detachably inserted through the first adjustment hole and the plurality of second adjustment holes and configured to lock the inner tube relative to the outer tube.

In a preferred embodiment, the locking device comprises: a pin detachably inserted through the first adjustment hole and the plurality of second adjustment holes, wherein a large head larger than the first adjustment hole and the plurality of second adjustment holes is provided on one end of the pin, and the locking device further comprises: a soft locking member of which one end is hinged to the large head and the other end is detachably assembled to the other end of the pin.

In a preferred embodiment, the locking device further comprises: a sliding sleeve movably sleeved on the outer tube, wherein a third adjustment hole corresponding to the first adjustment hole is provided on the sliding sleeve.

In a preferred embodiment, a foam handrail is provided on the outer tube.

After adopting the above technical solution, the beneficial effects of the present disclosure are as follows.

1. In the present disclosure, a plurality of hanging buckles are provided on the outer tube and/or inner tube, and the plurality of hanging buckles are provided with mounting holes, so that the multifunctional fitness horizontal bar can be easily installed with lifting rings, auxiliary cantilever belts, and tension belts and other fitness equipment, which is convenient for users to perform diversified exercises. Other fitness horizontal bars can only be fixed by auxiliary fixing, and the steps are cumbersome and unsafe.

2. In the present disclosure, not only an inner tube that can be telescopically and axially assembled on the inner ends of the outer tube is provided, but also an adjustable support member that can be telescopically and axially assembled on the outer end of the inner tube is provided to make the length of the multifunctional fitness horizontal bar can be adjusted in four steps, which is more precise and can adapt to more door widths.

3. In the present disclosure, with the safety nut, the relative position between the adjustable support member and the inner tube can be locked, and after the multifunctional fitness horizontal bar is installed on the door, it is more securely fastened. The relative position between the inner tube and the outer tube can be locked by means of the pin and the soft locking member, and after the multifunctional fitness horizontal bar is installed on the door, it is more secure and fastened.

BRIEF DESCRIPTION OF THE DRAWINGS

In order to more clearly explain the technical solutions in the embodiments of the present disclosure or the prior art, the following will briefly introduce the drawings that need to be used in the description of the embodiments or the prior art. Obviously, the drawings in the following description are just some embodiments of the present disclosure. For those of ordinary skill in the art, other drawings can be obtained based on these drawings without creative labor.

Figure 1:
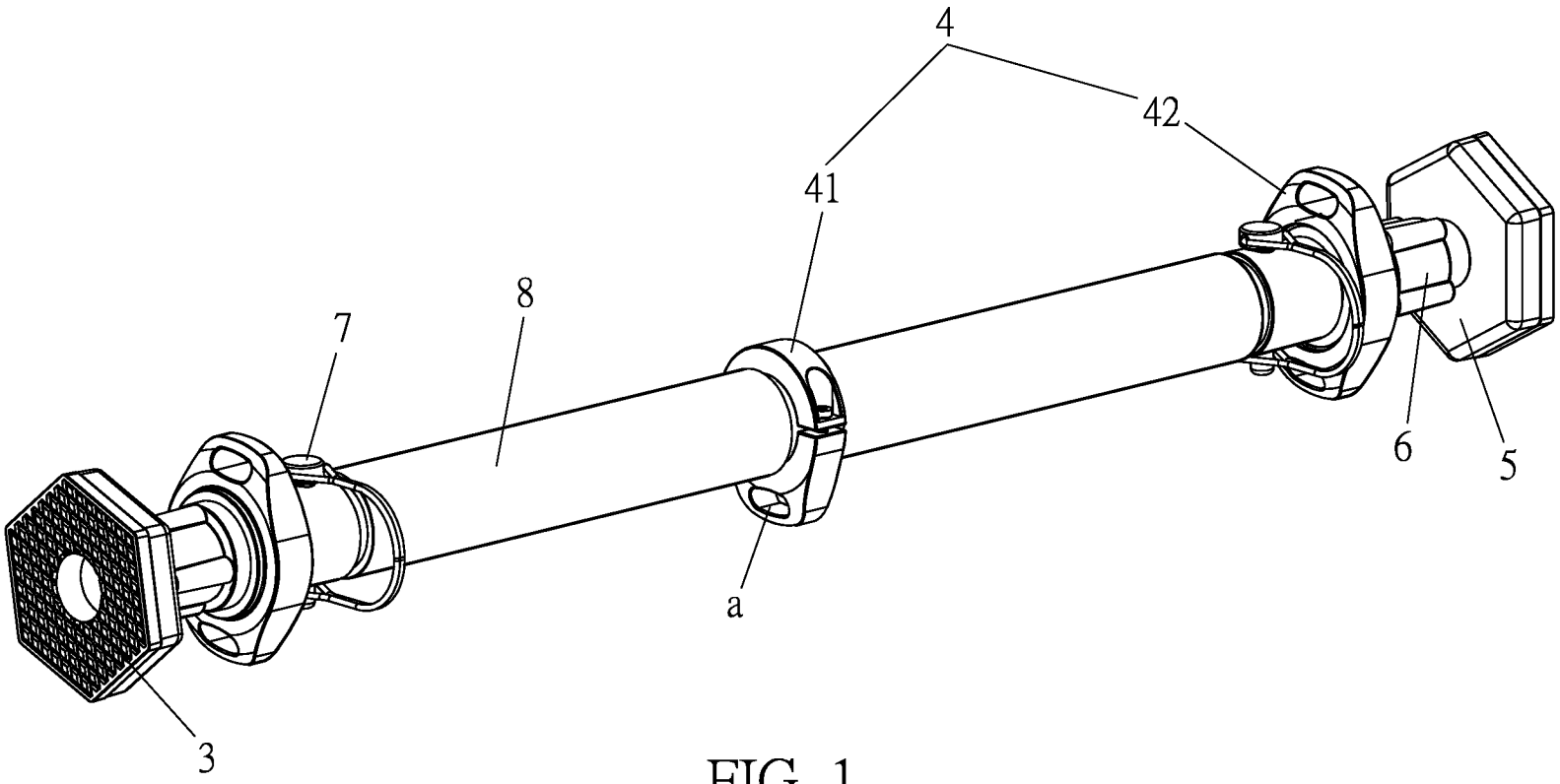
FIG. 1 is a schematic diagram of the structure of the present disclosure.

Reference numeral: 1. outer tube; 2. inner tube; 3. support part; 4. hanging buckle; 41. fixed hanging buckle; 42. rotating hanging buckle; 5. adjustable support member; 6. safety nut; 7. locking device; 71. pin; 711. big head; 72. soft locking member; 73. sliding sleeve; 8. foam handrail; a. mounting hole; b. first adjustment hole; c. second adjustment hole; d. third adjustment hole.

DETAILED DESCRIPTION OF THE EXEMPLARY EMBODIMENTS

The present disclosure will be further described in detail below in conjunction with the drawings.

This specific embodiment is only an explanation of the present disclosure, and it is not a limitation to the present disclosure. After reading this specification, those skilled in the art can make modifications that do not contribute to this embodiment as needed, but as long as they are within the scope of the claims of the present disclosure, they are protected by the patent law.

Figure 2:
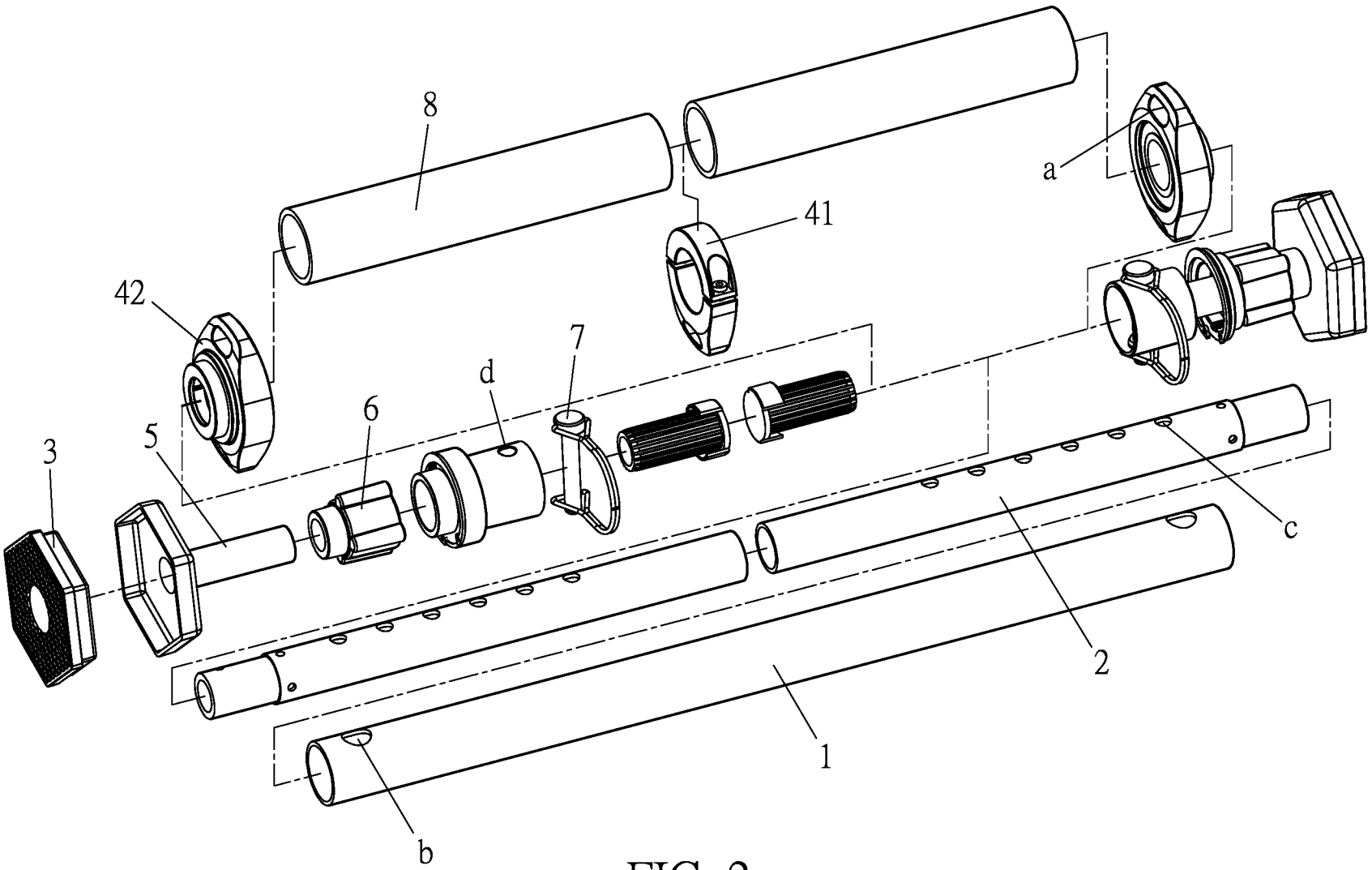
FIG. 2 is an exploded schematic diagram of the structure of the present disclosure.
Figure 3:
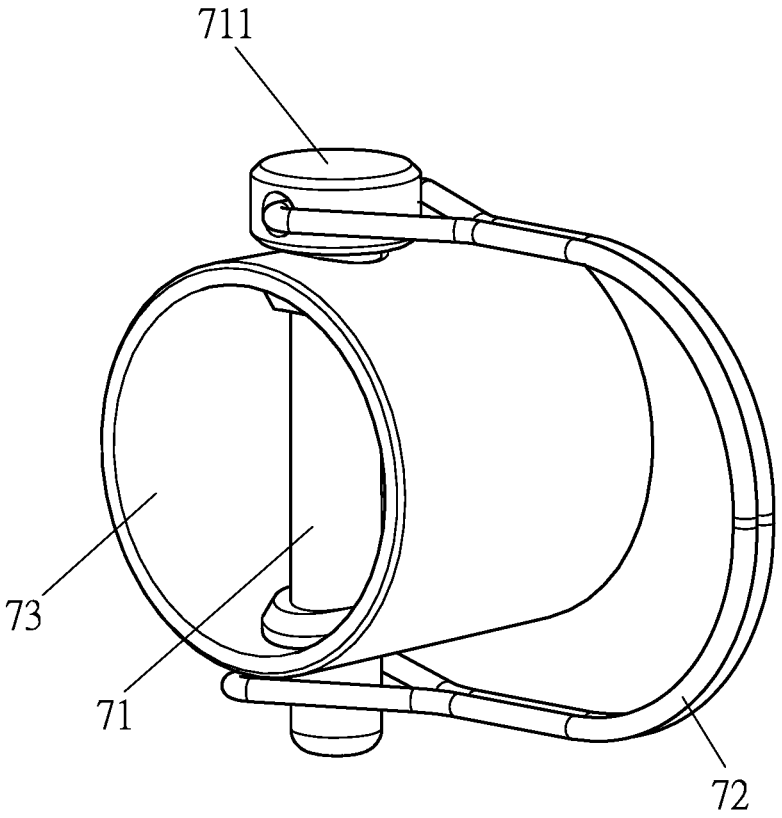
FIG. 3 is a structural diagram of the locking device.

The present embodiment relates to a multifunctional fitness horizontal bar, as shown in FIGS. 1 and 2, which comprises an outer tube 1, an inner tube 2 telescopically and axially assembled on both ends of the outer tube 1, a support part 3 provided on the outer side of the inner tube 2, and a plurality of hanging buckles 4 provided on the outer tube 1 and/or the inner tube 2, wherein a mounting hole a is provided on each of the plurality of hanging buckles 4, so that the multifunctional fitness horizontal bar can be conveniently equipped with hoisting rings, auxiliary cantilever belts, tension belts and other fitness equipment, which is convenient for users to perform diversified exercises. Other fitness horizontal bars can only be fixed by auxiliary fixing, and the steps are cumbersome and unsafe.

Further, as shown in FIGS. 1 and 2, each of the plurality of hanging buckles 4 comprises: a fixed hanging buckle 41 fixedly assembled on the middle of the outer tube 1, and a rotating hanging buckle 42 assembled on the outer end of the inner tube 2 and being capable of rotating 360° around the inner tube 2. The rotating hanging buckle 42 and the fixed hanging buckle 41 are used together, and can be used in conjunction with more fitness equipment.

In a preferred embodiment, as shown in FIG. 2, the multifunctional fitness horizontal bar further comprises: an adjustable support member 5 telescopically and axially assembled on the outer end of the inner tube 2. Not only the inner tube that can be telescopically and axially assembled on the inner ends of the outer tube is provided, but also the adjustable support member that can be telescopically and axially assembled on the outer end of the inner tube is provided to make the length of the multifunctional fitness horizontal bar can be adjusted in four steps, which is more precise and can adapt to more door widths.

In a preferred embodiment, as shown in FIGS. 1 and 2, a safety nut 6 for locking is arranged between the adjustable support member 5 and the inner tube 2, so that the relative position between the adjustable support member 5 and the inner tube 2 can be locked, and after the multifunctional fitness horizontal bar is installed on the door, it will not rebound due to the pressure on both sides, and will be more securely tightened.

In addition, as shown in FIG. 2, a first adjustment hole b is provided on both ends of the outer tube 1, a plurality of second adjustment holes c are provided on the inner tube 2, and the multifunctional fitness horizontal bar further comprises: a locking device 7 detachably inserted through the first adjustment hole b and the plurality of second adjustment holes c and configured to lock the inner tube 2 relative to the outer tube 1. With the locking device 7, the relative position between the inner tube 2 and the outer tube 1 can be locked. After the multifunctional fitness horizontal bar is installed on the door, it will not rebound due to the pressure on both sides, and the fastening is safer.

Specifically, the locking device 7 comprises: a pin 71 detachably inserted through the first adjustment hole b and the plurality of second adjustment holes c, wherein a large head 711 larger than the first adjustment hole b and the plurality of second adjustment holes c is provided on one end of the pin 71, and the locking device 7 further comprises: a soft locking member 72 of which one end is hinged to the large head 711 and the other end is detachably assembled to the other end of the pin 71. When in use, the inner tube 2 is slid to make the second adjustment hole c of the inner tube 2 overlap the first adjustment hole b of the outer tube 1, then the pin 71 is inserted into the hole, and finally the soft locking member 72 is fastened to complete the locking.

Further, the locking device 7 further comprises: a sliding sleeve 73 movably sleeved on the outer tube 1, wherein a third adjustment hole d corresponding to the first adjustment hole a is provided on the sliding sleeve 73. The arrangement of the sliding sleeve 73 is beneficial to protect the pin 71 and the soft locking member 72. When in use, the inner tube 2 is slid to make the second adjustment hole c on the inner tube 2 overlap the first adjustment hole b of the outer tube 1, then the sliding sleeve 73 is slid to make the third adjustment hole d correspond to the first adjustment hole b and the second adjusting hole c, and the pin 71 is inserted into the hole, and finally the soft locking member 72 is fastened to complete the locking.

A foam handrail 8 is provided on the outer tube 1 to make the hand more comfortable when grabbing the bar.

The working principle of the present disclosure is roughly as follows. By providing a plurality of hanging buckles 4 on the outer tube 1 and/or the inner tube 2, and mounting holes a on the plurality of hanging buckles 4, the multifunctional fitness horizontal bar can be easily installed rings, auxiliary cantilever belts, tension belts and other fitness equipment, which is convenient for users to perform diversified exercises. Other fitness horizontal bars can only be fixed by auxiliary fixing, and the steps are cumbersome and unsafe.

The above are only used to illustrate the technical solution of the present disclosure and not to limit it. Other modifications or equivalent substitutions made by a person of ordinary skill in the art to the technical solution of the present disclosure shall not depart from the spirit and scope of the technical solution of the present disclosure. It shall be covered in the scope of the claims of the present disclosure.

What is claimed is:

1. A multifunctional fitness horizontal bar, comprising: an outer tube (1), an inner tube (2) telescopically and axially assembled on first and second ends of the outer tube (1), a support part (3) provided on an outer side of the inner tube (2), and a hanging buckle assembly (4) provided on the outer tube (1) and/or the inner tube (2), wherein a mounting hole (a) is provided on the hanging buckle assembly (4); wherein a first adjustment hole (b) is provided on the first and second ends of the outer tube (1), a plurality of second adjustment holes (c) are provided on the inner tube (2), and the multifunctional fitness horizontal bar further comprises a locking device (7) detachably inserted through one of the first adjustment holes (b) and a hole of the plurality of second adjustment holes (c) and configured to lock the inner tube (2) relative to the outer tube (1); wherein the locking device (7) comprises a pin (71) detachably inserted through the one of the first adjustment holes (b) and the hole of the plurality of second adjustment holes (c), wherein a large head (711) larger than each first adjustment hole (b) and each of the plurality of second adjustment holes (c) is provided on one end of the pin (71), and the locking device (7) further comprises: a flexible locking member (72) of which one end is hinged to the large head (711) and the other end is detachably assembled to the other end of the pin (71); wherein the locking device (7) further comprises a sliding sleeve (73) movably sleeved on the outer tube (1), wherein a third adjustment hole (d) corresponding to each first adjustment hole (b) is provided on the sliding sleeve (73).

2. The multifunctional fitness horizontal bar according to claim 1, wherein the hanging buckle assembly (4) comprises: a fixed hanging buckle (41) fixedly assembled on a middle of the outer tube (1), and a rotating hanging buckle (42) assembled on a surface of a distal end of the inner tube (2) and being capable of rotating 360° around the inner tube (2).

3. The multifunctional fitness horizontal bar according to claim 1, further comprising an adjustable support member (5) telescopically and axially assembled on the outer side of the inner tube (2).

4. The multifunctional fitness horizontal bar according to claim 3, wherein a safety nut (6) for locking is arranged between the adjustable support member (5) and the inner tube (2).

5. The multifunctional fitness horizontal bar according to claim 1, wherein a foam handrail (8) is provided on the outer tube (1).

* * * * *